United States Patent [19]

Grise

[11] Patent Number: 4,774,397

[45] Date of Patent: Sep. 27, 1988

[54] ELECTRICAL SEMICONDUCTOR RESISTANCE HEATER

[76] Inventor: Frederick G. J. Grise, P.O. Box 186, Osterville, Mass. 02655

[21] Appl. No.: 68,958

[22] Filed: Jul. 1, 1987

[51] Int. Cl.[4] ..... H05B 3/34

[52] U.S. Cl. ..... 219/549; 219/528; 219/541; 219/544; 219/543; 338/212; 338/308

[58] Field of Search ..... 219/528, 529, 525, 544, 219/543, 549, 522, 535, 211; 338/22 R, 225 D, 212, 308, 309, 312; 174/68.5

[56] References Cited

U.S. PATENT DOCUMENTS

| | | | |
|---|---|---|---|
| 3,757,087 | 9/1973 | Bernard | 219/549 |
| 3,878,362 | 4/1975 | Stinger | 219/528 |
| 4,429,216 | 1/1984 | Brigham | 219/528 |
| 4,485,297 | 11/1984 | Grise et al. | 219/528 |
| 4,523,085 | 6/1985 | Grise | 219/528 |
| 4,542,285 | 9/1985 | Grise | 219/543 |
| 4,626,664 | 12/1986 | Grise | 219/525 |
| 4,690,347 | 9/1987 | Grise | 242/57.1 |

*Primary Examiner*—E. A. Goldberg
*Assistant Examiner*—M. M. Lateef

[57] ABSTRACT

A heater including a substrate having semiconductor bus stripes along each edge of one face. The semiconductor stripes are connected by a plurality of identically oriented bars. The bars include a feeder segment at each end and a divided segment connecting the feeder segments. The feeder segments are spaced ¼ inch apart. The divided segment is divided into equally spaced heating elements, each having a width equal to the width of the space between adjacent heating elements. The width of each heating element is 1/16 inch.

27 Claims, 4 Drawing Sheets

ELECTRICAL SEMICONDUCTOR RESISTANCE HEATER

BACKGROUND OF THE INVENTION

This invention relates to sheet resistance heaters, and more particularly to a flexible continuous sheet heater of the type described in U.S. Pat. No. 4,485,297 issued Nov. 27, 1984, U.S. Pat. No. 4,523,085 issued June 11, 1985, U.S. Pat. No. 4,542,285 issued Sept. 17 1985 and U.S. Pat. No. 4,690,347 issued Sept. 1, 1987 all of which are incorporated herein by reference.

In general, such heaters include a paper or plastic substrate on which is printed a semiconductor pattern (typically a colloidal graphite ink) having (a) a pair of conductor contact pistons extending parallel to each other and (b) a heating portion (typically a plurality of transverse bars) extending between and electrically connected to the conductor contact portions. A metallic conductor (typically copper stripping) overlies each of the conductor contact portions, and an overlying sealing layer is bonded to the substrate closely adjacent the opposite edges of the conductor and holds the conductor in tight face-to-face engagement therewith with the underlying conductor contact pistons.

Typical uses include area (e.g., ceiling or floor) heaters, pizza box heaters, thin heaters for pipes, wide heaters for under desks and tables, spaced heaters for greenhouse plant use, and as military thermal signature targets.

In resistance heating devices of the type described in the aforementioned patents and patent applications, the heating portion typically comprises a plurality of regularly spaced bars of essentially uniform width. It has been found that, in some applications, it is difficult to avoid excess localized heating of the portion of the conductor contact portion adjacent the end of each bar, particularly when relatively high resistance ink is used. It is also difficult to optimize the width of the space between adjacent bars, if the space is too wide there may be zones of uneven heating between adjacent bars; if it is too narrow, there is insufficient space for consistently secure tie-down of the copper conductors.

SUMMARY OF THE INVENTION

The present invention effectively solves the problems of localized heating at the heater edges, uneven heater between bars, and poor conductor tie-down. The invention features a heater in which each transverse heating portion includes a pair of feeder segments and a divided segment of narrower elements extending between the feeder segments and equally spaced from each other, typically at a distance equal to their width. The cross sectional area of each feeder segment is slightly greater than the sum of the cross sectional areas of the elements of the divided segments, thus ensuring that the feeder segments will be of lower resistance and will not overheat. The relatively narrow spaces between the narrower elements of each divided segment provides even heating of the sealing layers, and wider space between the feeder segments of adjacent heating portions provides sufficient bonding area when required for conductor tie-down.

DETAILED DESCRIPTION OF THE PREFERRED EMBODIMENTS

Figure 1:
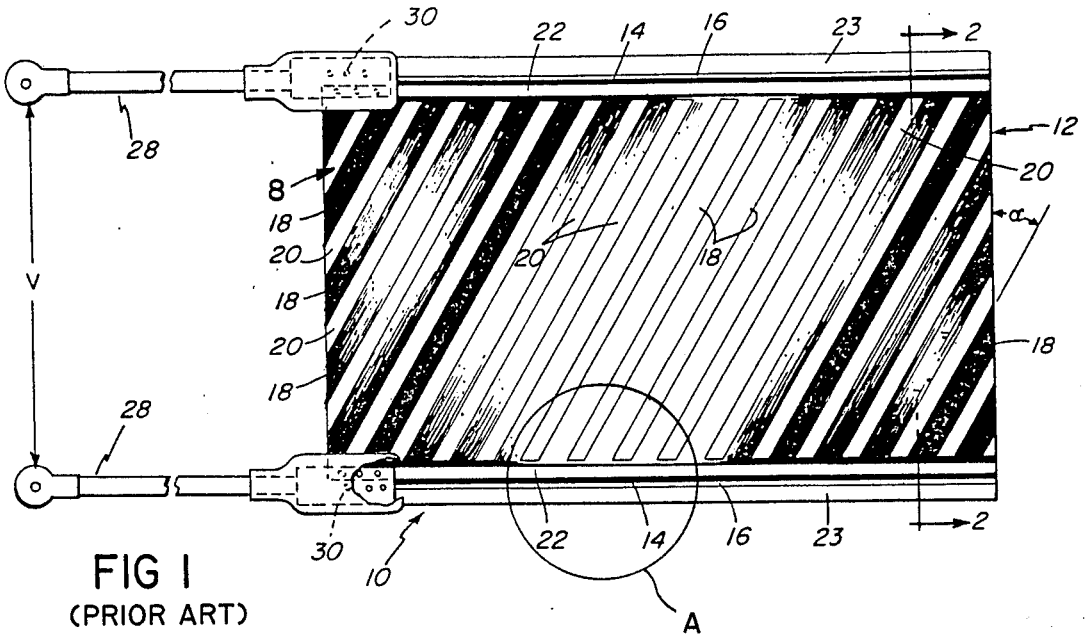
FIG 1 (PRIOR ART)
FIGS. 1 and 2 are views of a heater of the prior art.
Figure 2:
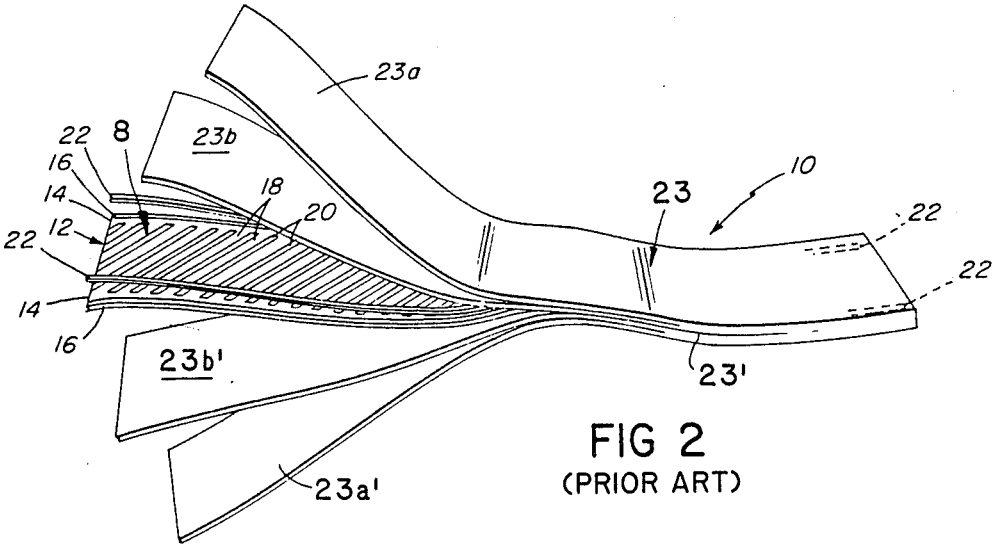
FIG 2 (PRIOR ART)

FIGS. 1–2 show a heater, generally designated 10 and including a substrate 12, of the type described in U.S. Pat. No. 4,485,297. A semiconductive pattern of colloidal graphite is printed on the top side of the substrate, typically by silkscreening. Substrate 12 is plastic, although paper or another suitable electrically insulating material may be employed also. As will be apparent, the substrate need not be insulating through its entire thickness, however, each face must be insulating.

As shown in FIG. 1, the graphite pattern printed on the top of substrate 12 includes a pair of parallel longitudinal conductor contact portions or stripes 14. Each stripe is 0.397 cm. (0.156 in.) wide and the inner edges of the stripes are 8.73 cm. (3.43 in.) apart. The overall width of the graphite pattern, thus, is 9.525 cm. (3.75 in.), and the substrate 12 on which the pattern is centered is of sufficient width (normally about 10 cm. or 4 in.) to leave a 0.79 cm. (0.31 in.) to about 0.64 cm. (0.25 in.) uncoated boundary 16 along each edge.

The graphite pattern includes also a plurality of identical regularly spaced semiconductor heating portions or bars 18 extending between stripes 14. Each bar 18 is 0.64 cm. (0.25 in.) wide (measured perpendicular to its edges) and the space 20 between adjacent bars (i.e., the unprinted area or "white" space) is 0.32 cm. (0.125 in.) wide. As shown, all of bars 18 extend in straight lines and form an angle, designated $\chi$, of 30° with a line extending perpendicularly between stripes 14. Since bars 18 are twice as wide as the spaces 20 between them, $66\frac{2}{3}$ percent of the area between stripes 14 is coated with semiconductor material.

In heater 10, and in the preferred embodiments of the present invention, the material forming the semiconductor is a conductive graphite ink (i.e., a mixture of conductive colloidal graphite particles in a binder) and is printed on the substrate at a substantially uniform thickness (typically about 0.00125 cm. or 0.0005 in. for the portion of the pattern forming bars 18 and about 0.0035 cm. or 0.0014 in. for the portions of the pattern forming stripes 14) using a conventional silk-screen process. Inks of the general type used are commercially available from, e.g., Asheson Colloidals of Port Huron, Mich. (Graphite Resistors for Silk Screening) and DuPont Electronic Materials Photo Products Department, Wilmington, Del. (4200 Series Polymer Resistors, Carbon and Graphite Base). A similar product, Polymer Resistant Thick Films, is sold by Methode Development Co. of Chicago, Ill. Semiconductor materials of the type used in the present invention are also discussed in the literature; see for example U.S. Pat. Nos. 2,282,832; 2,473,183; 2,559,077; and 3,239,403.

A copper conductor 22, typically 0.32 cm. (0.125 in.) wide and 0.0075 cm. (0.003 in.) thick, is placed in face-to-face contact with each longitudinal stripe 14. It will be noted that stripes 14 are slightly wider than conductors 22. This extra width is desirable because of manufacturing tolerances to insure that the conductor always fully engages an underlying stripe.

Electric leads 28 connect heater 10 to a voltage source 26. Each lead 28 includes a crimp-on connector 30 having pins which pierce plastic sheets 23 (described below) and engages an electrode 22.

In the embodiment shown in FIGS. 1–2, the graphite pattern (stripes 14 and bars 18) is printed on the upper face of substrate 12, and conductors 22 are hermetically sealed between substrate 12 and an overlying thin, transparent plastic sheet 23. Sheet 23 is a colamination of a 0.005 cm. (0.002 in.) thick polyester ("Mylar") dielectric insulator **23*a* and a 0.007 cm. (0.003 in.) thick adhesive binder, 23*b*, typically polyethylene. Plastic adheres poorly to graphite, but the polyethylene sheet 23*b* bonds well to substrate 12. In the illustrated embodiment, the polyethylene sheet 23*b* is heat sealed both to the uncoated boundaries 16 outside stripes 14 and, on the inside of conductors 22, to the uncoated spaces 20 between adjacent bars 18. Sheet 23*b* thus holds the conductors 22 tightly in place against stripes 14. It will be noted, however, that the conductor-to-stripe tie-down integrity is dependent on the portions of sheet 23 adjacent the inside edges of stripes 14 (and conductors 22) being firmly bonded to the semi-conductor-free spaces 20 between adjacent bars 18. If the spaces 20 are to narrow to permit good bonding, or if the bars 18 are so wide that the relatively poor plastic-to-graphite bond between them and sheet 23 permits a conductor 22 to lift off a stripe 14**, excessive localized heating, and perhaps heater burn-out, will result.

To further minimize undesirable heat generation (i.e., localized heating or "hot spots") at the interfaces between the conductors 22 and semiconductor stripe 14, and between the stripes 14 and bars 18, the resistance at both interfaces should be minimized. It will be seen that each semi-conductor bar 18 is electrically connected in series with a stripe 14 and conductor 22; and, in a series circuit, the most heat generally will be generated at zones of higher resistance.

Excessive heat generation adjacent the conductor-to-semiconductor stripe interface on the stripe-to-bar interface is undesirable for several reasons. It is wasteful, since it is desirable for heat to be generated where it is desired, in the central heating zone rather than at the edges of the heater 10; it makes for uneven heating; and too much heat at the conductor-stripe or stripe-bar interface could cause arcing, burn-out and, possible, fire. In general, excessive interface resistance adversely affects the performance, life and safety of the heater.

Figure 3:
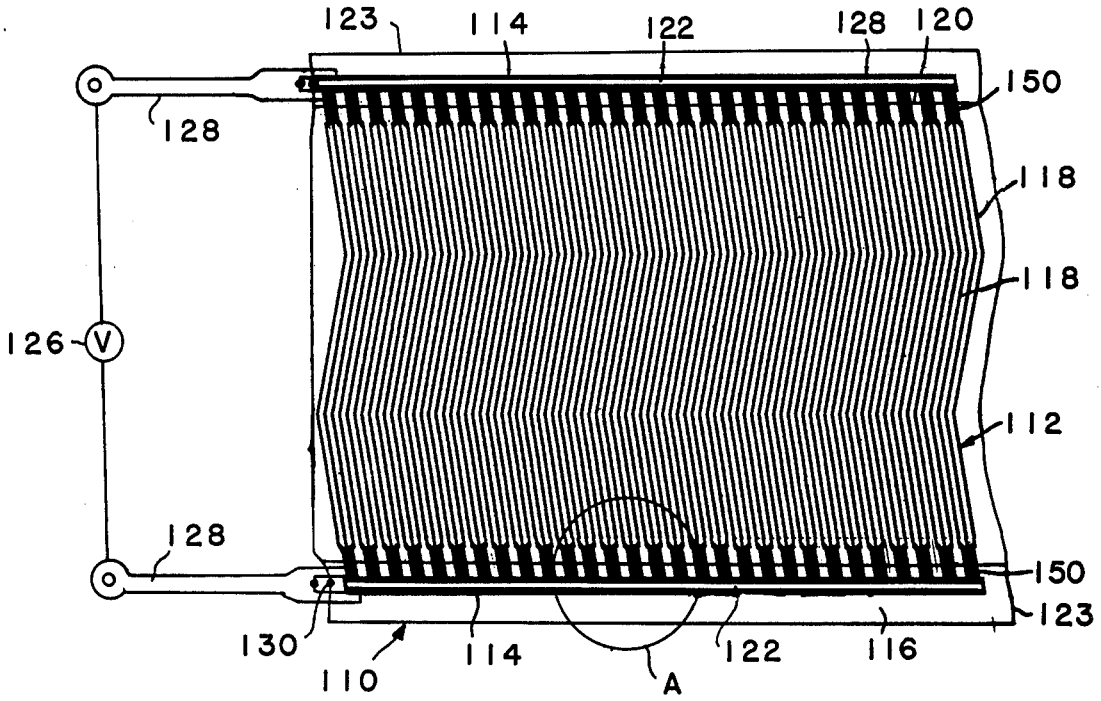
FIG. 3 is a plan view of one embodiment of the present invention.

FIG. 3 shows a resistance heater 110, embodying the invention, in which there is greater conductor-to-stripe tie-down integrity and a greatly reduced likelihood of high interface resistance. Many aspects of heater 110 are the same as the known resistance heater 10, described above; and corresponding components are identified by reference numbers 100 greater than the numbers used in identifying components in the heater 10 shown in FIGS. 1–2.

As shown in FIG. 3, heater 110 includes a substrate 112 on which is printed a semiconductor pattern of colloidal graphite ink, made up of parallel, longitudinally-extending bus stripes 114 and spaced-apart, transverse heating portions 118. A copper conductor 122 is in face-to-face engagement with each semiconductor stripe. Conductors 122 are held in tight face-to-face engagement with stripes 114 by strips of transparent plastic sealing tape 123 (rather than a larger single sheet such as sheet 23). Each tape strip 123 is about 1½ inch wide and is positioned to overly a respective one of conductors 122 and the underlying stripe 114. The tape strips 123 are bonded to substrate 112 (typically with a pressure sensitive adhesive) along the uncoated boundaries 116 at the outside edges of the respective conductor 122 and stripe 114, and in the spaces 120 at the inside edges of the conductor and stripe between adjacent transverse heating portions 118.

A voltage source 126 supplies a potential across conductors 122 through leads 128 and connectors 130.

Figure 5:
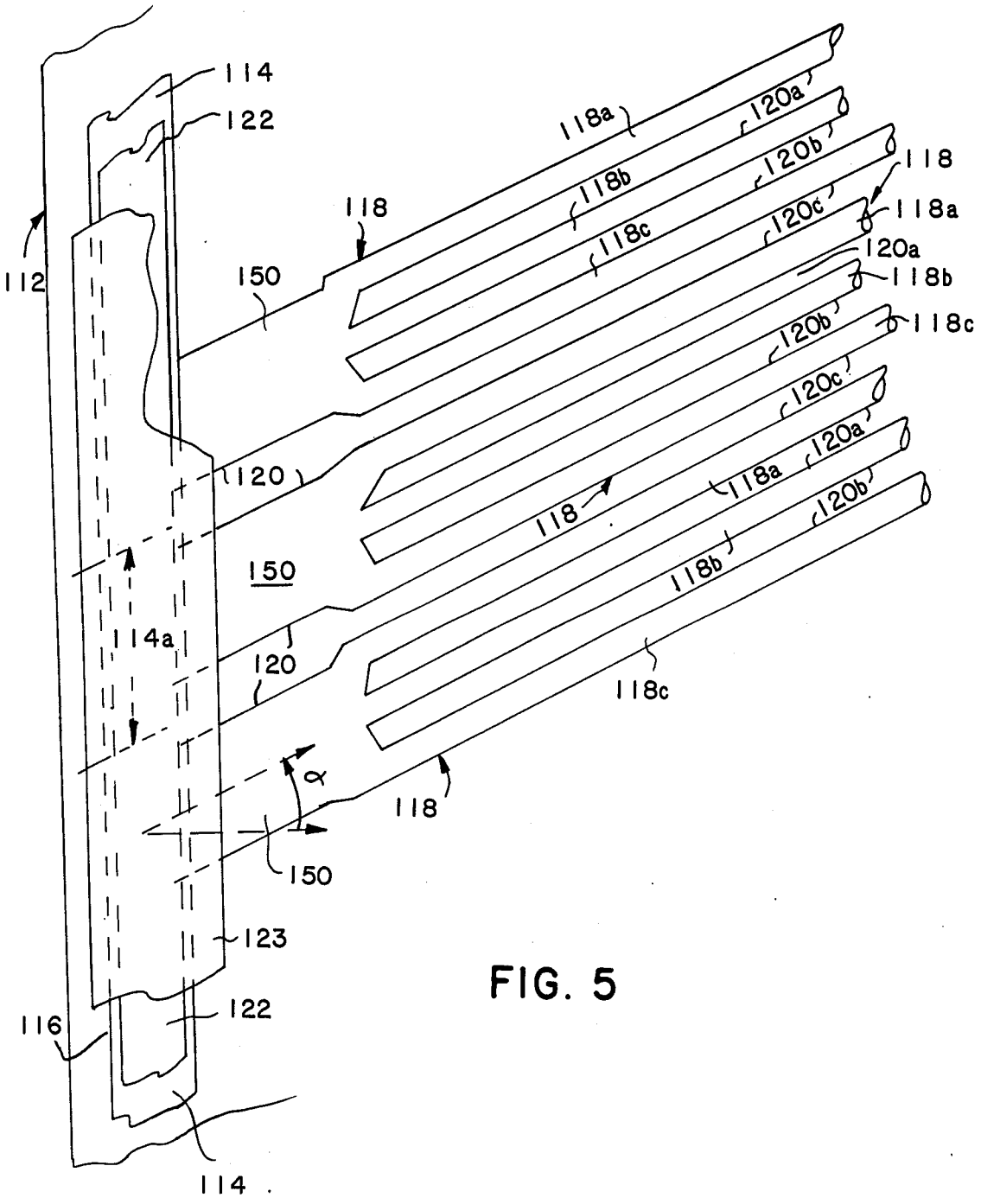
FIG. 5 is a schematic view of the portion of the heater of FIG. 3, showing the junction between the feeder segment of a heating portion and a conductor contact portion.

Referring now to FIGS. 3 and 5, it will be seen that each heating portion or bar 118 includes a pair of feeder segments, designated 150, attached to the opposite ends of a trifurcated center portion includes three relatively thin, longitudinally-spaced apart, transversely-extending heating segments or barlets **118*a*, 118*b*, 118*c*. Barlets 118*a*, 118*b*, 118*c* are essentially identical to each other, except of course at their ends where they converge as necessary for them to connect to feeder elements 150. The entire bar 118 extends across the heater along a zigzag path. The initial component of the zigzag bar is at an angle $\chi$ with respect to a line perpendicular to the stripes 114 of approximately 10°. At each zigzag juncture, each bar 118 (and barlet) reverses direction so that it makes an angle of approximately 10° with respect to a line perpendicular to the stripes 114**, in the opposite direction.

In the illustrated embodiment, each feeder segment 150 extends 0.5 inch (1.2 cm.) inwardly from a respective one of stripes 114, and is 0.25 inches long (measured longitudinally of heater 110). Because the bars 118 are inclined at an angle relative to a straight line extending perpendicularly between stripes 114, the center line length of each feeder segment will be slightly greater than ¼ inch; in the illustrated embodiment in which the inclination is 10°, the center line length of each feeder segment 150 is about 0.51 in. The distance between the center lines of adjacent feeder segments, again measured longitudinally of heater 110) is ⅜ inch, thus providing a space 120⅛ inch wide (measured longitudinally) between the generally transverse edges of adjacent feeder segments. As shown, the width of the feeder segments 150 is sufficient to insure that tape strips 123 do not overlie the barlets **118*a*, 118*b*, 118*c*. It has been found that the pressure sensitive adhesives which bond tape strips 123 to substrate 112** typically increase the resistivity of any portions of the semi-conductor pattern with which they are in contact, and it is desirable that any such increase in resistivity be confined to the feeder segments.

Measured longitudinally of heater 110, each barlet **118*a*, 118*b*, 118*c* is 1/16 inch wide, and the spaces 120*a*, 120*b* between adjacent barlets also are 1/16 inch in width. The center-to-center distance between adjacent feeder segments 150 (and also the center-to-center distance between adjacent bars 118) is ⅜ inch. It will thus be seen that the space 120*c* between the barlets 118*a*, 118*c* of adjacent bars 118 is 1/16 inch wide also; and that the heating area of heater 110 (i.e., the area between feeder segments 150) thus comprises substantially identical 1/16 in. wide barlets 118** with substantially identical 1/16 inch wide semi-conductor-free spaces between.

Figure 4:
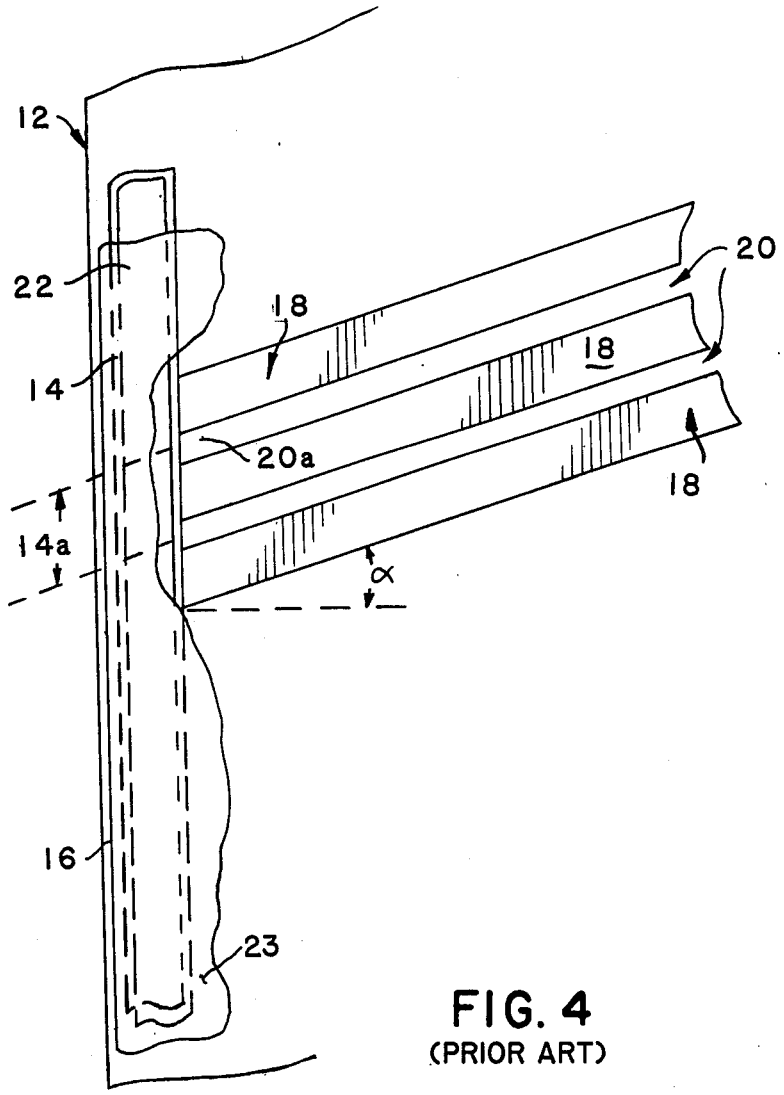
FIG. 4 (PRIOR ART)
FIG. 4 is a schematic view of a portion the heater of FIG. 1, showing the junction between the semiconductor heating portions and conductor contact portions.

The manner by which the heater of the present invention minimizes interface resistance and provides superior even heating while at the same time insuring good conductor-to-stripe tie-down is illustrated by comparing FIG. 5 with FIG. 4.

First, and perhaps most more important, each feeder segment 150 provides a current path the width (¼ inch) of which is greater than the sum of the widths of the barlets 118*a*, 118*b* and 118*c* (total width 3/16 inch) to which it is connected, thus insuring (since the feeder segments and barlets are the same thickness) that the resistance in the feeder segment is less than that in the barlets. It will also be noted that the ratio (2:1) of (a) the length (⅜ in.) of the portion 114*a* of stripe 114 associated with each bar to (b) the sum of the widths of the barlets 118*a*, 118*b* and 118*c* (3/16 in.) of the bar is greater than is the corresponding ratio (1.5:1) of the length (⅜ in.) of the portion 14*a* of a stripe 14 of heater 10 to the width (¼ in.) of the asscciated bar 18.

Further, the relatively narrow (1/16 inch) spaces between adjacent barlets of substantially the same 1/16 inch width insures essentially even heating throughout the central heating area of heater 110; heat from the barlets can easily and evenly flow into the narrow spaces 120*a*, 120*b*, and 120*c*.

Turning now to the problem of insuring that the conductors 122 are maintained in tight face-to-face contact with the underlying stripes 114, it has been found that, to insure good tie-down, the semi-conductor free spaces at the inside edges of stripes 114 and conductors 122 should be not less than about 0.3 cm. (about ⅛ inch) long (measured longitudinally of stripes 114) and not less than about 0.45 cm. (about 3/16 inch) wide (measured generally perpendicular to stripes 114). Semi-conductor free spaces as narrow (about 1/16 inch) as the spaces 120*a*, 120*b* between barlets 118*a*, 118*b*, 118*c* and the spaces 120*c* between adjacent bars would, in many circumstances, be too narrow to insure sufficient bonding of tape strips 123 (or an overlying larger sheet such as sheet 23) to substrate 112 to hold conductors 122 in place (although it should be noted that such narrow spaces usually are sufficient to secure the central portion of a top cover sheet such as sheet 23 to the substrate).

The 0.317 cm. (0.125 in.) (measured longitudinally of stripes 114) by 1.27 cm. (0.500) (measured perpendicular to stripes 114) spaces 120 between adjacent feeder segments 150, each of which extends inwardly from the inside edge of a stripe 114, provides a semi-conductor free bonding area sufficiently large to insure that tape strips 123 hold conductors 122 tightly against stripes 114.

Using a semi-conductor pattern comprising relatively narrow, e.g., 0.159 cm. (0.0625 inc.), spaces between barlets of similar width provides other beneficial results. In a silk-screen printing process, it is difficult to maintain low line-to-line variations in resistance for bars having a width of ¼ inch or less. This is thought to be because, when the doctor blade passes over such relatively wide spaces in the silk-screen mask, the blade sweeps across the width of the cutout and leaves a thick ridge of ink. With numerous barlets, as in the present invention, much more uniformity is achieved. By printing with narrower (e.g., 3/32 in. wide or less) bars typically, variations in resistance can be reduced to about ±2%; with ¼" wide bars, the variation is about ±5%. It is believed that maintaining $\chi$ at approximately 10° (e.g., 8°–11°) also assists in minimizing resistance variations.

Other Embodiments

As indicated above, other embodiments may include, in lieu of tape strips 123, an organic plastic sealing sheet (essentially identical to sheet 23 of the prior heater discussed with reference to FIGS. 1–2) that overlies and is heat sealed to substantially the entire upper surface of the heater. In such embodiments, the problem of increased resistance due to interaction between the semi-conductor material and a pressure sensitive material is normally not present, and feeder segments 150 typically will be about ¼ inch, rather than about ½ inch, long.

Similarly, other embodiments may employ heating portions 118 in which the number of barlets extending between relatively wide feeder segments is other than three, e.g., the central portion may be bi-furcated (2 barlets), quad-furcated (4 barlets), etc. As a practical matter, each barlet should be not less than about 0.08 cm (about 1/32 inch) wide.

In one exemplary bi-furcated arrangement, a plastic sealing sheet of the same construction as discussed in connection with FIGS. 1 and 2 overlies the entire heater surface, and each feeder segment is 0.25 inches long (measured perpendicular to stripes 114) and has the same width (0.25 inch measured longitudinally of stripes 114) as in heater 110. However, the width of each of the two barlets (and of the spaces between adjacent barlets) is 3/32 in. rather than 1/16 in.

In an embodiment in which the central portion includes eight barlets, each barlet (and the space between adjacent barlets) is 1/32 inch wide, and the width of the feeder segments is ¼ inch, i.e., equal to the total width of the eight barlets to which it is connected.

In these and other preferred embodiments, the space between adjacent feeder segments will be not less than about ⅛ in. (to provide for secure conductor tie-down), the sum of the widths of each set of barlets is no more (and preferably less) than the width of the feeder segments to which they are connected and not more than half the center-to-center distance of adjacent bars, and the spaces between adjacent barlets will be of uniform width, usually the same width as the barlets themselves.

What is claimed is:

1. An electrical heating device comprising:

a substrate having at least one electrically insulating surface;

a semi-conductor pattern carried on said electrically insulating surface, said pattern including a pair of conductor contact portions generally parallel to and spaced apart from each other and a plurality of heating portions spaced apart from each other and extending between and electrically connected to said conductor contact portions; and, a pair of elongated conductors, each of said conductors having a resistance less than that of said heating and conductor contact portions and overlying one of said conductor contact portions in direct electrical engagement therewith, said heating device being characterized in that each of said heating portions comprises a feeder segment at each end thereof connected to a respective one of said conductor contact portions, and a divided segment including a plurality of elongated heater elements the opposite ends of which are connected to said feeder segments, the sum of the widths of the heater elements of each of said heating portions is not greater than the width of said feeder segments, said heater element and feeder segment widths being measured longitudinally of said conductor contact portions, and, the distance between the feeder segments of adjacent ones of said heater portions is greater than the distance between adjacent ones of said heater elements of a said heater portion, said distances between feeder segments and between heater elements being measured longitudinally of said conductor contact portions.

2. The heating device of claim 1 wherein said conductors comprise metal strips and including an electrically insulating sheet overlying at least one of said conductors and the one of said conductor contact portions associated therewith, said sheet being sealed at one side of said at least one conductor to portions of said substrate intermediate adjacent ones of said feeder segments and closely adjacent the side of said associated conductor contact portion.

3. The heating device of claim 1 wherein said conductor contact portions extend generally longitudinally of said device and said heating portions extend generally transversely of said device.

4. The heating device of claim 2 wherein said heating portions are substantially identical to each other.

5. The heating device of claim 1 wherein the distance between the adjacent sides of adjacent feeder segments is not less than about ⅛ inch.

6. The heating device of claim 5 wherein said distance is about ¼ inch.

7. The heating device of claim 1 wherein the distance between the adjacent sides of adjacent heating elements of a said heating portion is not more than about 3/32 inch.

8. The heating device of claim 7 wherein said distance is about 1/16 inch.

9. The heating device of claim 1 wherein the distance between adjacent sides of the adjacent heating elements of a said heating portion is substantially equal to the width of the said heating elements of said heating portion.

10. The heating device of claim 1 wherein the distance between adjacent heating elements of a said heating portion is substantially equal to the distance between adjacent said heating portions.

11. The heating element of claim 1 wherein the sum of the width of the heating elements of a said heater portion is less than the width of each feeder segments of said feeder segment.

12. The heating device of claim 1 wherein each of said heating portions comprises:

(a) two straight line end portions, each of which:

(i) is oblique to one of said conductor contact portions; and (ii) includes a said feeder segment and a heater element; and (b) a plurality of straight line mid-portions, each of which forms an obtuse angle with each adjacent straight line portion.

13. The heating device of claim 12 wherein the degree to which each straight line end portion is oblique with respect to said conductor contact portion is between approximately 8° and 11°, and the degree to which each straight line mid-portion is obtuse with respect to each adjacent straight line portion is between approximately 158° and 164°.

14. The heating device of claim 1 wherein the width of each of said heater elements is not more than about 3/32 in.

15. The heating device of claim 1 wherein each of said heating portions includes not less than 2 and not more than 8 of said heating elements.

16. The heating device of claim 14 where each of said heating portions includes 3 of said heating elements.

17. The heating device of claim 15 wherein each of said heating elements is about 1/16 in. wide, the width of each of said feeder segments is about ¼ inch, and the distance between the heating element of adjacent heating portion is about 1/16 inch.

18. An electrical heating device comprising:

a substrate having at least one electrically insulating surface;

a semi-conductor pattern carried on said electrically insulating surface and including a plurality of heating portions spaced apart from each other; and, a pair of elongated, spaced-apart conductors, each of said conductors having a resistance less than that of said semi-conductor pattern and being in direct electrical engagement with said semi-conductor pattern, said heating device being characterized in that said of said heating portions comprises a feeder segment at each end thereof closely adjacent and electrically connected to a respective one of said conductors, and a divided segment including a plurality of elongated heater elements the opposite ends of which are connected to said feeder segments, the sum of the widths of the heater elements of each of said heating portions is not greater than the width of said feeder segments, both of said widths being measured longitudinally of said conductors, and, the distance between the feeder segments of adjacent ones of said heater portions is greater than the distance between adjacent ones of said heater elements of a said heater portion, said distances between feeder segments and between heater elements being measured longitudinally of said conductors.

19. The heating device of claim 18 wherein said conductors extend generally longitudinally of said device and said heating portions extend generally transversely of said device.

20. The heating device of claim 18 wherein said heating portions are substantially identical to each other.

21. The heating device of claim 18 wherein the distance between the adjacent sides of adjacent feeder segments is not less than about ⅛ inch.

22. The heating device of claim 18 wherein the distance between the adjacent sides of adjacent heating elements of a said heating portion is not more than about 3/32 inch.

23. The heating device of claim 18 wherein the distance between adjacent sides of the adjacent heating elements of a said heating portion is substantially equal to the width of the said heating elements of said heating portion.

24. The heating device of claim 23 wherein the distance between adjacent heating elements of a said heating portion is substantially equal to the distance between adjacent said heating portions.

25. The heating element of claim 18 wherein the sum of the width of the heating elements of a said heater portion is less than the width of each feeder segments of said feeder segment.

26. The heating device of claim 18 wherein each of said heating portions includes not less than 2 and not more than 8 of said heating elements.

27. The heating device of claim 26 wherein each of said heating elements is about 1/16 in. wide, the width of each of said feeder segments is about ¼ inch, and the distance between the heating element of adjacent heating portion is about 1/16 inch.

* * * * *